United States Patent [19]

Raikov

[11] Patent Number: 4,782,776

[45] Date of Patent: Nov. 8, 1988

[54] LOOPER TO MACHINE FOR SEWING-UP NETTING WEBS

[75] Inventor: Nikolai N. Raikov, Kerch, U.S.S.R.

[73] Assignee: Tsentralnoje Projektno-Konstruktorskoje I Tekhnologicheskoje Bjuro Vsesojuznogo Rybopromyshlennogo Objedinenija Azovo-Chernomorskogo Basseina, Sevastopol, U.S.S.R.

[21] Appl. No.: 49,105

[22] PCT Filed: Jul. 30, 1985

[86] PCT No.: PCT/SU85/00065

§ 371 Date: Mar. 9, 1987

§ 102(e) Date: Mar. 9, 1987

[87] PCT Pub. No.: WO87/00874

PCT Pub. Date: Feb. 12, 1987

[51] Int. Cl.[4] ..... D05B 1/10

[52] U.S. Cl. ..... 112/270; 112/154; 112/199

[58] Field of Search ..... 112/109, 111, 165, 166, 112/197, 199, 222, 227, 443, 154, 270

[56] References Cited

U.S. PATENT DOCUMENTS

| | | | |
|---|---|---|---|
| 235,579 | 12/1880 | Smith | 112/443 |
| 343,949 | 6/1886 | Cummings et al. | 112/111 |
| 4,271,769 | 6/1981 | Barnes | 112/222 X |

FOREIGN PATENT DOCUMENTS

| | | | |
|---|---|---|---|
| 2655283 | 8/1978 | Fed. Rep. of Germany | 112/165 |
| 147377 | 4/1981 | German Democratic Rep. | 112/166 |
| 379701 | 4/1973 | U.S.S.R. . | |
| 346965 | 7/1976 | U.S.S.R. . | |
| 820292 | 11/1976 | U.S.S.R. . | |

*Primary Examiner*—Wm. Carter Reynolds
*Attorney, Agent, or Firm*—Lilling & Greenspan

[57] ABSTRACT

A triple thread chain stitch machine for sewing netting. A knee shaped needle (1) is mounted on a reciprocating bar (2). A stud on the needle is received by the bar (12) for rotation about the stud. A lug (19) on the needle cooperates with a catch (22) to limit needle rotation.

3 Claims, 3 Drawing Sheets

LOOPER TO MACHINE FOR SEWING-UP NETTING WEBS

BACKGROUND OF THE INVENTION

Field of the Invention

The invention relates to the textile industry, and more particularly it relates to loopers incorporated in machines for sewing-up webs of netting.

Description of the Prior Art

There is known a looper to a machine for sewing-up netting webs, including a knee-shaped needle operatively connected with the main shaft of the machine, mounted on a vertical bar of the machine overlying the device for guiding the webs of netting towards the needle, and carrying the needle thread.

The knee-shaped needle includes a stud and a blade with a passage and the eye of the needle, interconnected by a bend or crosspiece (cf. SU Inventor's Certificate No. 820 292, published in "Discoveries. Inventions" Bulletin No. 28 on July 30, 1983).

In machines of this kind the looper in the form of a knee-shaped needle carrying the first looping thread interacts with a working needle carrying the needle thread and with a hook-shaped looper driven through a complex three-dimensional motion and carrying the second looping thread.

When the loop formed by the second looping thread is engaged, the blade of the knee-shaped needle enters the path of the hook which at this moment commences its motion from the rear dead centre in the direction of the working stroke of the needle, and sheds the loops formed of the needle thread and the first looping thread. So as to avoid being engaged by the blade of the needle driven through its working stroke, i.e. moving downwardly, and thus to prevent a breakdown, the hook brought close to the needle instantly turns about the longitudinal axis of the bar carrying it, as the needle takes the loop formed of the second looping thread, for the tip of the hook to clear the path of the needle in due time before their encounter, and thus to bypass the needle. This instant motion is controlled by the appropriate stationary cam of the machine interacting with a spring-urged pivoted arm of the bar carrying the looper hook. As the main shaft of the machine attains a corresponding angular speed, the follower on the pivoted arm of the bar carrying the looper hook, while rolling down the slope of the cam toward its centre, alternatingly clears (rises off) the cam and then strikes it under the action of the spring, causing excessive noise and vibration of the machine, and also interfering with loop formation. To abate the noise and vibration and to improve the conditions of the taking of the loop of the second looping thread by the needle, the rotational speed of the main shaft is reduced, i.e. the sewing speed is slowed down. In this arrangement it is impossible to make the control cam less steep, i.e. to make its grade smoother and thus to enhance the dynamics of the machine performance and provide for a higher sewing speed, since this would lead to inadvertent engagement between the looper hook and the needle, which amounts to a breakdown. If, on the other hand, the looper hook is moved aside from the needle path somewhat earlier, the blade of the needle would not enter the loop of the second looping thread, and a stitch would not be made. As the loop of the second looping thread is cast off the blade of the needle, its runs extend all but perpendicularly to the blade with its tip and the needle eye, so that the loop is caught by the tip of the needle blade, the loop-shedding is delayed, and the runs of the loop are overextended, which affects the stitch-forming process, and the shedding of the loop is accompanied by a specific snap causing additional vibration of the loopers and thus interfering with a normal looping operation.

In the construction of the prior art the looper needle is fixed on the reciprocating bar of the machine, its blade at the moment of taking the successive loop of the thread of the looper hook obstructing the passage of the latter, which results in their mechanical engagement and relative slipping requiring a considerable effort.

Furthermore, the tip of the needle eye at the end of the point of the blade obstructs the shedding of a loop of the thread of the looper hook. The runs of the loop of the thread of the looper hook, when being shed, extend at an angle relative to the tip of the needle eye, so that the loop is caught by the tip as if the latter were a hook. The runs of the loop are thus overextended, the timing of the loop-shedding is impaired, the stitch-forming is affected, and the looper mechanisms are subjected to an additional load.

SUMMARY OF THE INVENTION

The object of the present invention is to create a looper of which the design and interaction with the bar of the machine should enhance the reliability of the stitching operation.

This object is attained in a looper to a machine for sewing-up netting webs, comprising a knee-shaped needle operatively connected with the main shaft of the machine and including a stud and a blade interconnected by a crosspiece, the blade having a passage and the eye of the needle, in which looper, in accordance with the present invention, the knee-shaped needle is mounted on a vertical bar for rotation about its vertical axis and is associated with means for limiting this rotation and returning the crosspiece with the blade into their normal position.

The disclosed improvement of the looper enhances the reliability of the stitching operation, as the provision for rotation of the crosspiece with the blade about the vertical axis of the bar enables the blade of the needle to have its tip accommodating the eye of the needle being turned to extend along the runs of the loop of the hook thread as the loop is shed by the needle, thus preventing the loop being caught on the tip of the blade, which improves the process of forming a successive stitch in chain-stitching.

Furthermore, the provision of the means for limiting the rotation of the crosspiece with the blade and returning it into its normal position permits for a deviation of the blade of the looper needle from its normal position in case of inadvertent engagement with the looper hook as the blade takes the loop of the thread of the looper hook, thus relieving the accompanying strain and minimizing the dynamic load applied to the mechanisms of the machine, which enhances still further the reliability of the stitching operation.

It is expedient from the mechanical point of view to provide for rotation of the crosspiece with the blade relative to the vertical axis of the bar by pivotally connecting the stud of the needle with the bar.

The means for limiting the rotation of the crosspiece with the blade and returning it into its normal position is preferably in the form of a lug with a catch, fixed on the vertical bar and interacting with another lug fixed on the crosspiece of the needle with the aid of a rod and a spring mounted on the crosspiece.

BRIEF DESCRIPTION OF THE DRAWINGS

The invention will be further described in connection with an embodiment thereof, with reference being made to the accompanying drawings, wherein.

DESCRIPTION OF A PREFERRED EMBODIMENT OF THE INVENTION

Figure 1:
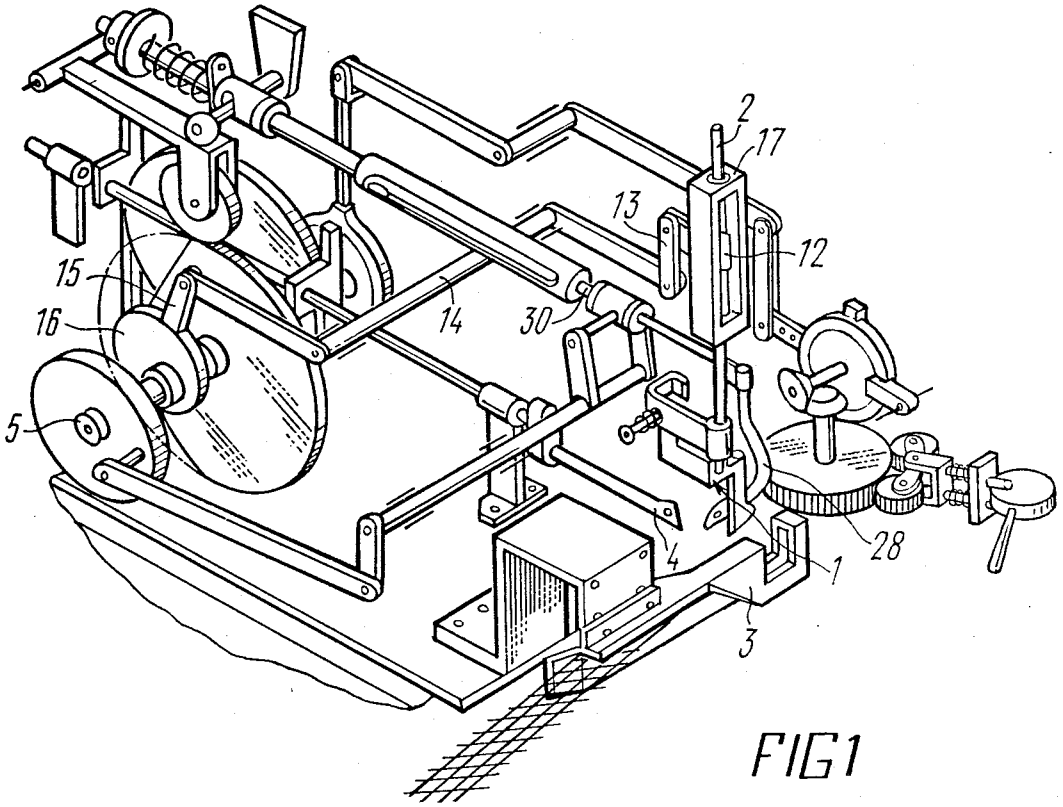
FIG. 1 illustrates the kinematic chain of a machine for sewing-up netting webs by triple-thread chain-stitches, in a perspective view with some of the elements removed for purposes of clarity.

The disclosed looper to a machine for sewing-up netting webs by a triple-thread chain-stitches includes a knee-shaped needle 1 (FIG. 1) mounted on a vertical bar 2 of the machine overlying the device 3 for guiding the webs of netting toward the needle 4 carrying the needle thread, the needle 1 being operatively connected with the main shaft 5 of the machine.

The knee-shaped needle 1 comprises a stud 6 (FIG. 2) and a blade 7 having a passage 8 and a tip 9 with the eye 10 of the needle, the passage 8 and the eye 10 serving to guide a stitching thread.

The stud 6 and the blade 7 are interconnected by a bend or crosspiece 11.

The operative connection between the knee-shaped needle 1 and the main shaft 5 (FIG. 1) of the machine includes a driver 12, a connecting link 13, a rocker 14, a rod 15 and a cam 16, the bar 2 being mounted for reciprocation in guiding sleeves 17.

Figure 2:
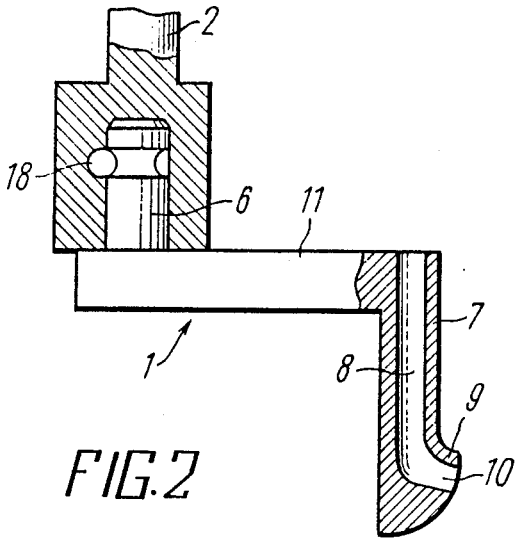
FIG. 2 is a longitudinal sectional view of a looper in accordance with the present invention.

In accordance with the invention, the knee-shaped needle 1 is mounted on the bar 2 for rotation about its vertical axis. This rotation is provided for by the stud 6 being pivotally mounted on the bar 2 and retained by a pin 18 (FIG. 2).

The knee-shaped needle 1 is associated with the means for limiting the rotation of the crosspiece 11 with the blade 7 about the vertical axis of the bar 2 and for returning the crosspiece 11 with the blade 7 into the normal position. This means includes and abutment or lug 19 (FIGS. 3 and 4) fixed on the crosspiece 11 and interacting through a spring 20 with another abutment or lug 21 fixed on the reciprocating vertical bar 2 and carrying a catch 22.

Figure 3:
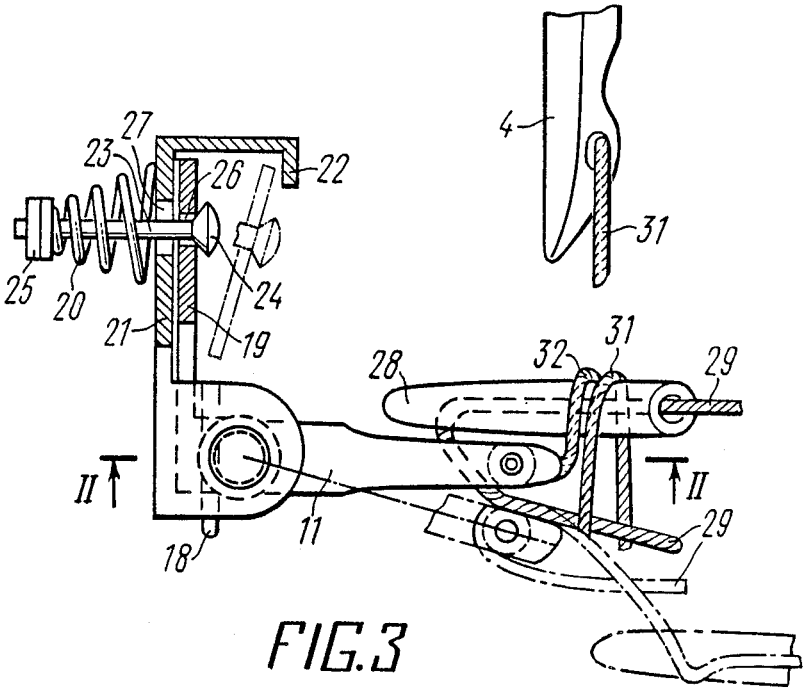
FIG. 3 is a longitudinally sectional view, partly broken away of a looper in accordance with the invention, in interaction with the looper hook and the needle carrying the needle thread.
Figure 4:
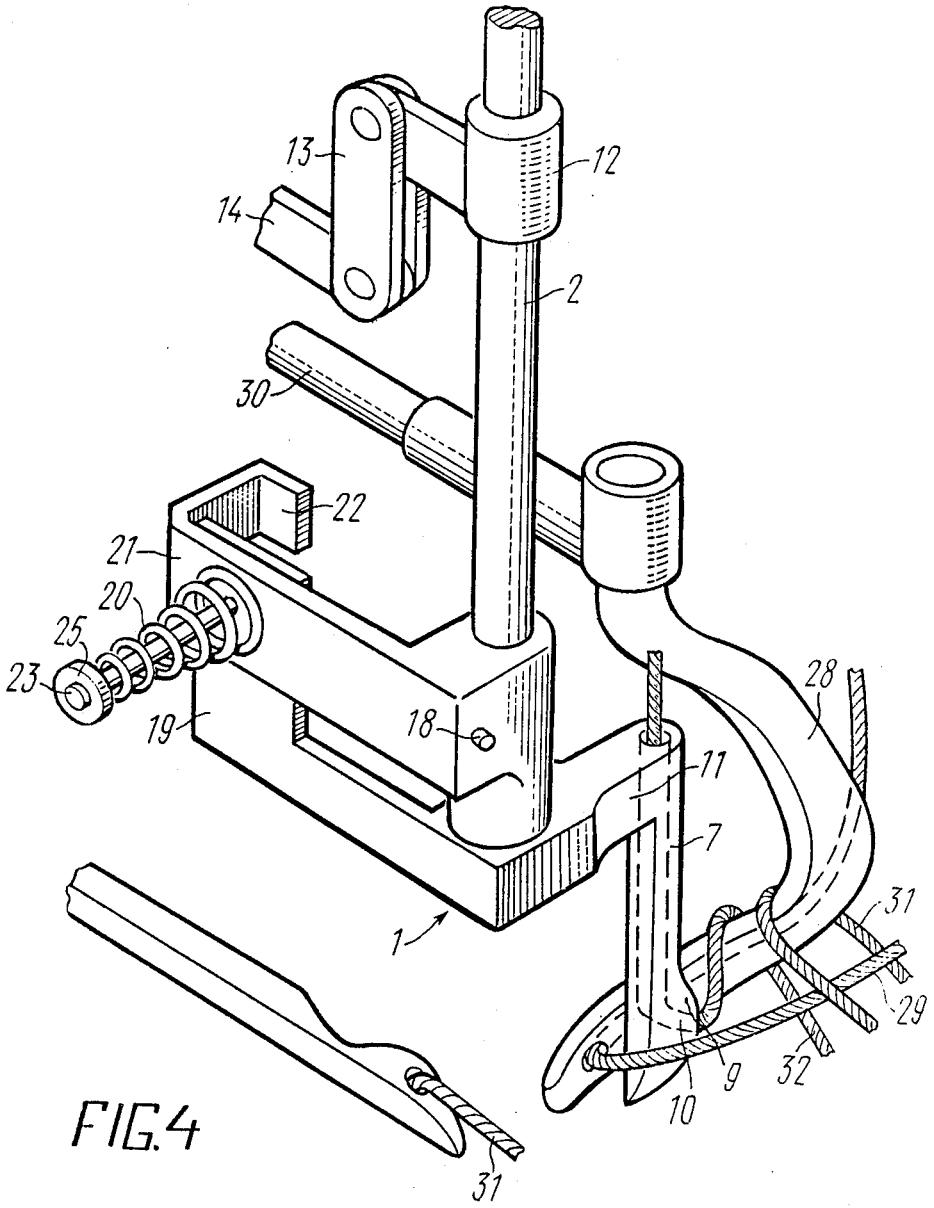
FIG. 4 is a perspective view of the looper in interaction with the looper hook and the needle carrying the needle thread.

The spring 20 is received about a horizontal rod 23 provided with a head 24 (FIG. 3) and carrying a nut 25 (FIG. 4). The rod 23 (FIG. 3) passes through the through-going slots 26 and 27 made, respectively, in the lugs 19 and 21.

The looper operates, as follows.

The main shaft 5 acting through the cam 16, rod 15, rocker 14, connecting link 13 and driver 12 drives the needle 1 through reciprocations along the vertical axis of the bar 2 carrying the knee-shaped needle 1. As the bar 2 moves down, and the looper hook 28 of the machine is at the rear dead centre of its motion along a three-dimensional path, the blade 7 of the needle 1 enters the loop formed by the thread 29 carried by the looper hook 28. At this moment the looper hook 28 leaves its rear dead centre and at the same time rotates counterclockwise (in the drawing) relative to the longitudinal axis of the bar 30 (FIG. 4) on which it is mounted in a cantilever fashion, shedding the loops of the thread 31 (FIG. 3) of the needle 4 and of the thread 32 of the blade 7 of the needle 1, and passing by the blade 7 at the right. While thus moving, the looper hook 28 contacts the blade 7 and slips therealong. The spring 20 is compressed, letting the crosspiece 11 with the lug 19 turn with respect to the lug 21 about the vertical axis of the bar 2. As the looper hook 28 moves further on and sheds the loops of the needle thread 31 and of the thread 32 of the needle 1 onto the loop of the thread 29 of the looper hook 28 itself, the thread of the loop 29 is retained on the blade 7 of the needle 1, urging away the crosspiece 11 until the lug 19 engages the catch 22. Meanwhile, the tip 9 with the needle eye 10 moves inside the loop of the thread 29 (this is shown in FIG. 3 with dash-and-dot lines) and does not interfere with the subsequent shedding of the loop off the blade 7 onto the loop of the thread 32 of the needle 1 of the looper. With the loop of the thread 29 cast off the needle 1 of the looper, the crosspiece 11 with the blade 7 are returned into their normal position by the effort of the spring 20. This cycle is then repeated for making the successive stitch.

With the needle of the looper having been designed for limited rotation of the crosspiece with the blade about the axis of the vertical bar and for returning subsequently into the normal position, it has been made possible, when adjusting the machine, to set the looper hook closer to the blade of the looper needle at the moment when the loop of the thread carried by the looper hook is taken by the needle of the looper. Consequently, the blade of the looper needle moves with more precision intermediate the looper hook and its thread, avoiding missed stitches.

Moreover, the provision for rotation of the crosspiece of the looper needle has enabled a more prolonged contact between the looper hook and the blade of the looper needle, so that the cam actuating the looper hook may have smoother grades, which permits higher rotational speeds of the main shaft of the machine without a hazardous growth of dynamic loads.

The provision for rotation of the crosspiece with the blade of the looper needle in mechanical engagement with the looper hook relieves the strain in their driving mechanisms, brings down the load applied to the main drive of the machine and eliminates the noise formerly associated with impacts of the looper hook against the looper needle.

INDUSTRIAL APPLICABILITY

The machine can be employed with the utmost effectiveness in the production of industrial fishing implements, such as fishing trawls, purse seines and others.

The invention can be also employed in the manufacture of bags made of netting for shipment of vegetables and fruit.

What is claimed is:

1. A looper machine for sewing-up netting webs, comprising a knee-shaped needle (1) operatively connected with the main shaft (5) of the machine and including a stud (6) and a blade (7) interconnected by a crosspiece (11), the blade (7) having a passage (8) and the eye (10) of the needle (1), the knee-shaped needle (1) being mounted on a vertical bar (2) of the machine, characterized in that the knee-shaped needle (1) is mounted on the vertical bar (2) of the machine for rotation of the crosspiece (11) with the blade (7) about the vertical axis of the bar (2) and is associated with means for limiting this rotation and returning the crosspiece (11) with the blade (7) into the normal position.

2. A looper machine according to claim 1, characterized in that the rotation of the crosspiece (11) with the blade (7) about the vertical axis of the bar (2) is provided for by pivotal connection of the stud (6) of the needle (1) with the bar (2).

3. A looper machine according to claim 1, characterized in that the means for limiting the rotation of the crosspiece (11) with the blade (7) about the vertical axis of the bar (2) and returning it into the normal position includes a lug (21) with a catch (22), fixed on the vertical bar (2) and interacting with another lug (19) fixed on the crosspiece (11) of the needle (1) with the aid of a rod (23) and a spring (20) mounted on the cross-piece (11).

* * * * *